US005783135A

United States Patent [19]

Smith et al.

[11] Patent Number: 5,783,135

[45] Date of Patent: Jul. 21, 1998

[54] DEMOULDING APPARATUS

[75] Inventors: Alan John Smith, Swindon; Maurice Roy Sims; Leslie Richard John Allen, both of Ashbourne, all of Great Britain

[73] Assignee: Camas UK Limited, Cheltenham, England

[21] Appl. No.: 635,889

[22] PCT Filed: Oct. 20, 1994

[86] PCT No.: PCT/GB94/02308

§ 371 Date: Jul. 29, 1996

§ 102(e) Date: Jul. 29, 1996

[87] PCT Pub. No.: WO95/11119

PCT Pub. Date: Apr. 27, 1995

[30] Foreign Application Priority Data

Oct. 23, 1993 [GB] United Kingdom ..... 9321923

[51] Int. Cl.[6] ..... B28B 7/06; B28B 13/06

[52] U.S. Cl. ..... 264/313; 249/127; 264/334; 425/440

[58] Field of Search ..... 425/440; 249/127; 264/313, 334

[56] References Cited

U.S. PATENT DOCUMENTS

| | | | |
|---|---|---|---|
| 2,269,557 | 1/1942 | Sexton | 25/1 |
| 3,061,500 | 10/1962 | Kreier, Jr. | 264/313 |
| 3,142,106 | 7/1964 | Wise | 425/440 |
| 3,655,317 | 4/1972 | Funkhouser et al. | 425/165 |
| 4,008,034 | 2/1977 | Kane | 425/441 |

FOREIGN PATENT DOCUMENTS

| | | | |
|---|---|---|---|
| 2 219 633 | 9/1974 | France . | |
| 2 469 992 | 5/1981 | France . | |
| 845261 | 7/1949 | Germany | 264/313 |
| 958091 | 9/1982 | U.S.S.R. | 425/440 |
| 1577968 | 7/1990 | U.S.S.R. | 249/127 |
| 1 498 833 | 1/1978 | United Kingdom . | |

*Primary Examiner*—James Derrington
*Attorney, Agent, or Firm*—Adams Law Firm, P.A.

[57] ABSTRACT

For use in manufacturing concreted building products in polyurethane molds, a demolding apparatus provides a clamping bar which clamps on to a lip of a mold (22) and is then moved with pivotal arms (32,34) forward and upwardly to effectively strip the edge of the mold (22) form the front end of the respective product (24). The reciprocating mold (22) passes below a roller (66) which moves into engagement with the upper surface of the mold (22) to apply a downwardly directed pressure onto the mold and product, thereby to retain the product (24) on a conveyor (12) and rollers (68), and facilitate stripping of the mold (22) from the product (24). The stripped product (24) moves onto an offtake conveyor (70) and, in the uppermost position of the arm (32,34), the clamping jaws are released to allow the stripped mold (22) to thereafter fall onto the conveyor (70).

18 Claims, 4 Drawing Sheets

DEMOULDING APPARATUS

This application is a national stage application, according to Chapter II of the Patent Cooperation Treaty. This application claims the priority date of Oct. 23, 1993, for UK Patent Application No. 9321923.6.

This invention relates to demoulding apparatus, particularly apparatus for automatically removing flexible moulds from moulded components such as concrete building products.

At the present time, flexible moulds, such as polyurethane moulds, are usually manually stripped from moulded concrete building products. This has several disadvantages, not the least of which is that the demoulding is very labour intensive. In GB1498833, an open-topped flexible mould with a moulded component therein is moved along a belt conveyor. At the position of a drum roller at the end of the conveyor, edges of the mould engage with abutment members which cause the mould to move around the drum roller but enable the moulded component to continue on a linear path away from the mould. Such an arrangement has limited use, for example only for shallow moulds.

According to the present invention there is provided demoulding apparatus comprising means for supporting a mould with a moulded component therein, characterised by means for releasably gripping the mould, and means for moving the gripping means in such a direction away from the support means that a mould formed of a flexible material, when gripped at one edge by the gripping means, can be stripped from said one edge of the component to an opposed edge thereof, whereby to remove the mould from the component.

Preferably the apparatus includes means for retaining the moulded component on the supporting means while the mould is stripped from the component.

Preferably also the supporting means includes a conveyor for moving the mould with the component therein in a linear path to an operative location of the gripping means. The supporting means may further include means over which the component can continue to move in the linear path as the mould is separated therefrom.

The gripping means may include a clamp which is movable between an inoperative position and an operative position wherein the clamp grips said one edge of the mould. The clamp may be supported by an arm arrangement which is movable through an angle. The clamp may comprise clamping jaws, the movement of which is pneumatically controlled, preferably by a pair of spaced pneumatic piston and cylinder assemblies towards respective ends thereof.

The retaining means may be movable between an inoperative position and an operative position wherein the retaining means engages the mould with the component therein in a spaced relation to said one edge, whereby to enable stripping as the component continues to move along the linear path. The retaining means may be in the form of a freely rotatable roller, or in the form of a trolley with freely rotatable wheels, which may be controlled by a pneumatic piston and cylinder assembly.

The apparatus may be associated with a further conveyor, one end of which is located adjacent to a loading position, and the other end of which is located adjacent to means for moving the demoulded component and the empty mould, whereby a mould supporting member can be removed from the mould before loading the latter, and the mould supporting member can be moved by the further conveyor from said one end thereof to the other where the mould support member can be reunited with an empty mould. The apparatus may be adapted to strip a plurality of moulds from respective components simultaneously.

The invention also provides a demoulding method comprising the steps of supporting a flexible mould with a moulded component therein, and characterised by gripping one edge of the mould, and moving the mould in a direction away from the supporting means, whereby to strip the mould from said one edge of the component to an opposed edge thereof, whereby to remove the mould from the component.

Preferably the method includes the step of retaining the component on the supporting means while the mould is stripped from the component. The mould may be moved through an angle away from the component.

Preferably the mould with the component therein is moved in a linear path to an operative location whereat the mould is clamped and moved away from the supporting means, the component continuing to move in the linear path to enable stripping of the mould from the component. Pressure may be applied to the mould with the component therein at a spaced location from said one edge of the mould, whereby to retain the component on the supporting means while separation takes place.

An embodiment of the present invention will now be referred by way of example only, with reference to the accompanying drawings.

BRIEF DESCRIPTION OF THE DRAWINGS

FIG. 4 shows a modification of part of the apparatus.

Referring to the drawings, FIG. 3 shows a twin lane demoulding line incorporating a demoulding apparatus 10 into which products are delivered by a twin lane roller chain conveyor 12 from an operator feed station 14. Concrete building products are often produced in single cavity or multicavity polyurethane moulds supported in wooden trays, which are transported to the feed station 14 on pallets by a forklift truck. Operators at the feed station 14 lift each tray with the mould and the moulded product from the pallet and, by upturning the tray, load the mould with the product upside down on to the conveyor 12. Gravity roller conveyors 16, 18 are located on respective sides of the conveyor 12, the conveyor 16 being provided with a lift gate 20 to enable operator access to the demoulding apparatus 10. The operator places an empty tray onto the adjacent one of the conveyors 16, 18, the empty tray then travelling to the other end of the respective conveyor for a purpose hereinafter described.

Figure 1:
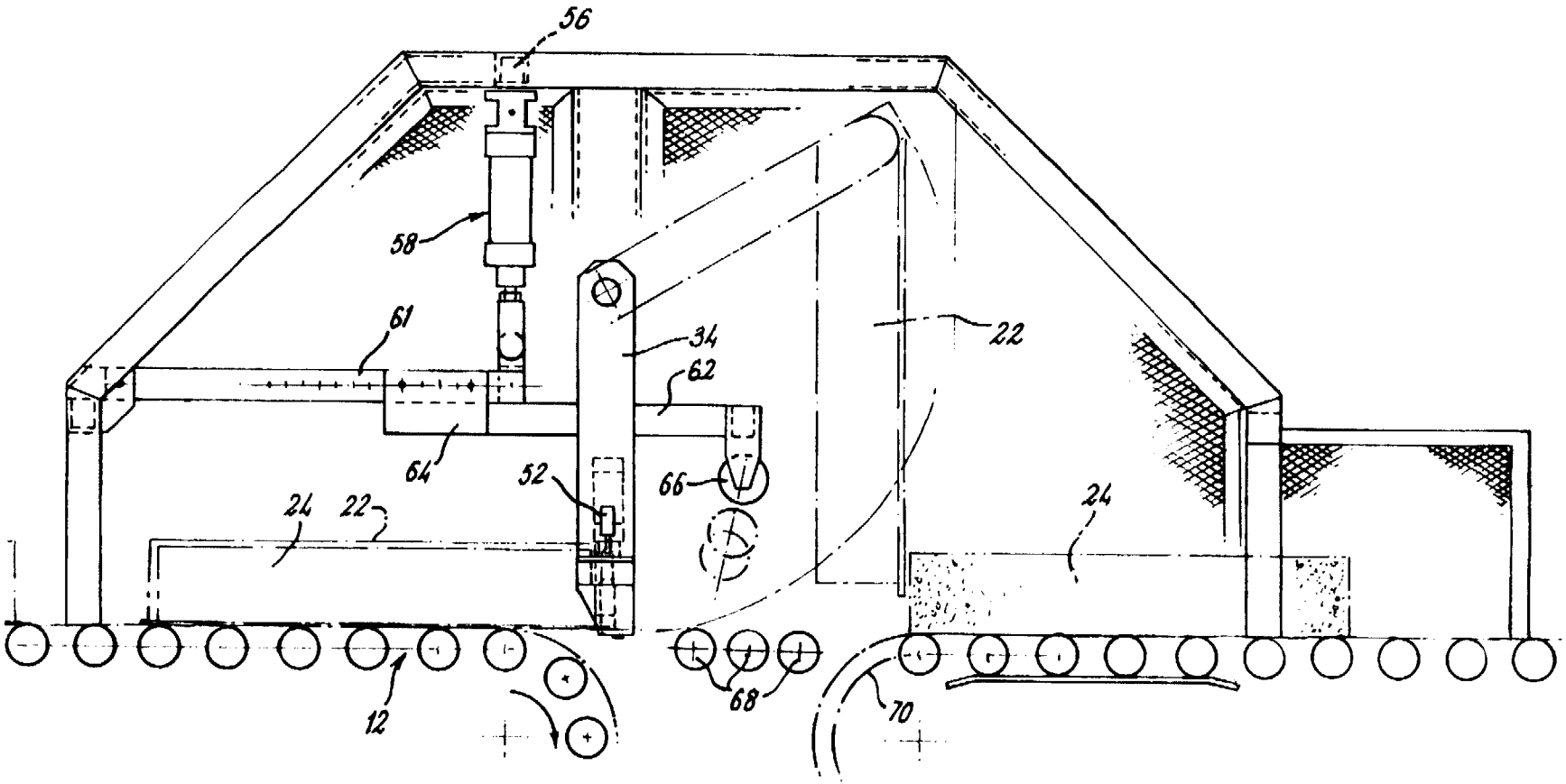
FIG. 1 is a schematic side elevation of an apparatus according to the invention.

Pairs of upturned moulds 22 (see FIG. 1) with the respective moulded products 24 are delivered into the apparatus 10 by the conveyor 12. Each of the moulds 22 is formed with an outwardly extending peripheral lip which, when the mould is upturned on the conveyor 12, rests on the latter. The apparatus 10 has frame members which mount demoulding components as hereinafter described, with wire mesh extending between the respective frame members for operator protection. Extending laterally of the apparatus 10 between opposite vertical frame members 26, 28 (FIG. 2) is a rotatable drive shaft 30, on respective ends of which are mounted first ends of a pair of arms 32, 34 which are rotatable with the shaft 32 for a purpose hereinafter described. In a modification, the axis of rotation of the arms 32, 34 may be adjustable. Each arm 32, 34 mounts, on an inner face, respective mounting lugs 36, 38 for a respective cylinder 40, 42 of a piston cylinder assembly. Each piston 44, 46 extends from the associated cylinder and mounts on its free end a respective leg of a laterally extending clamping bar 48 which has closable clamping jaws. A pair of detection pads 50 are provided on the clamping bar 48 at locations engageable by each pair of moulds 22.

Figure 2:
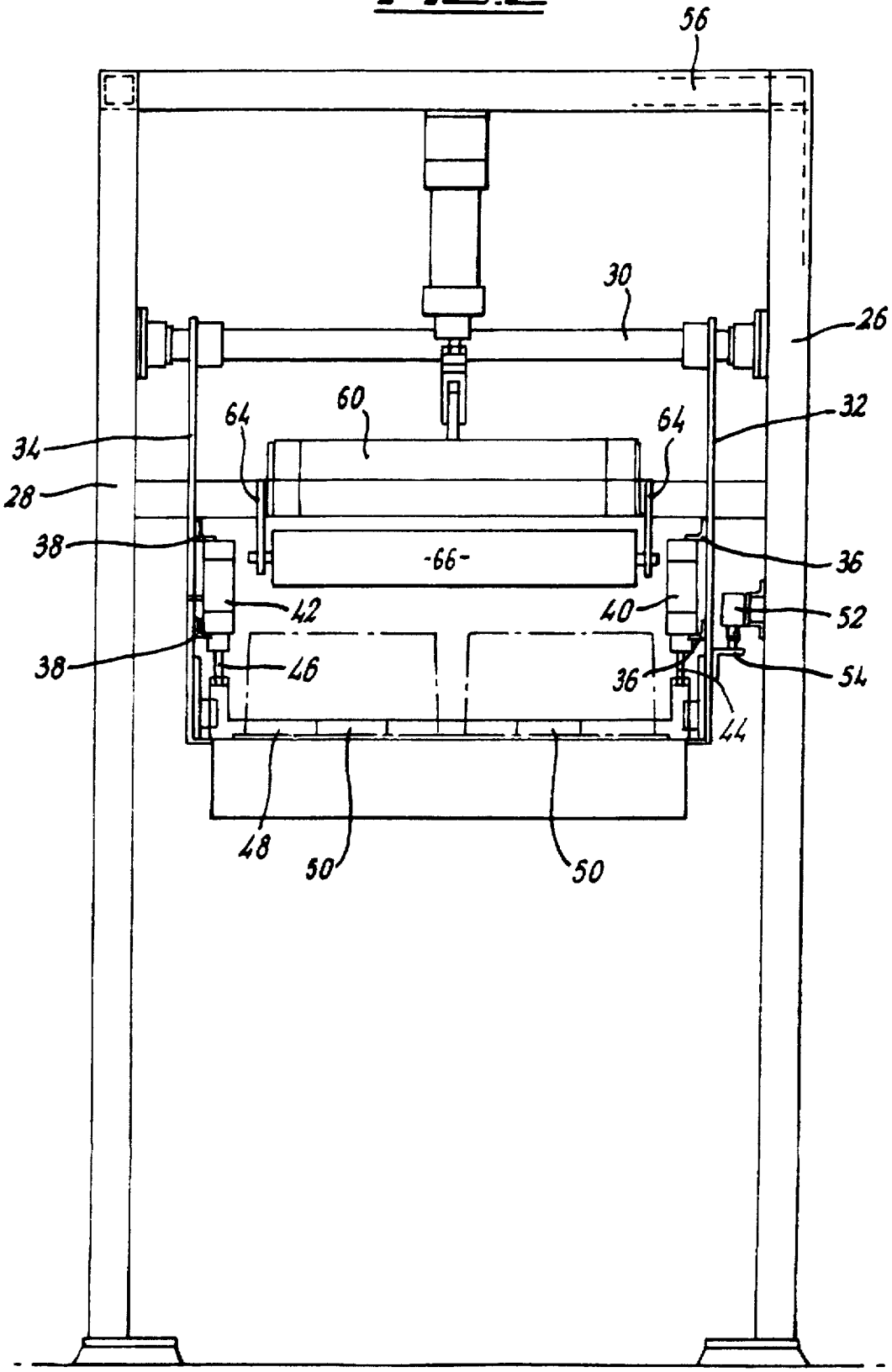
FIG. 2 is an end elevation.
Figure 3:
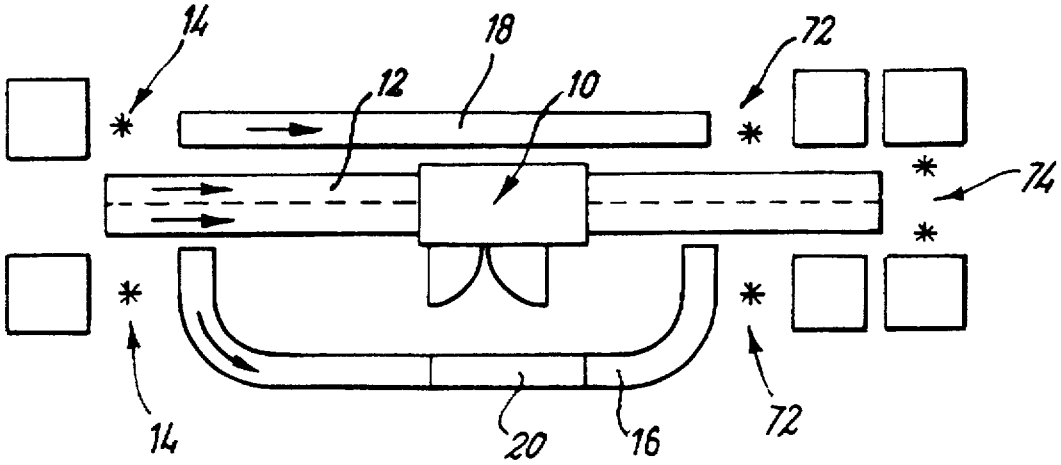
FIG. 3 is a schematic plan of a demoulding line incorporating an apparatus of the invention.
Figure 9:
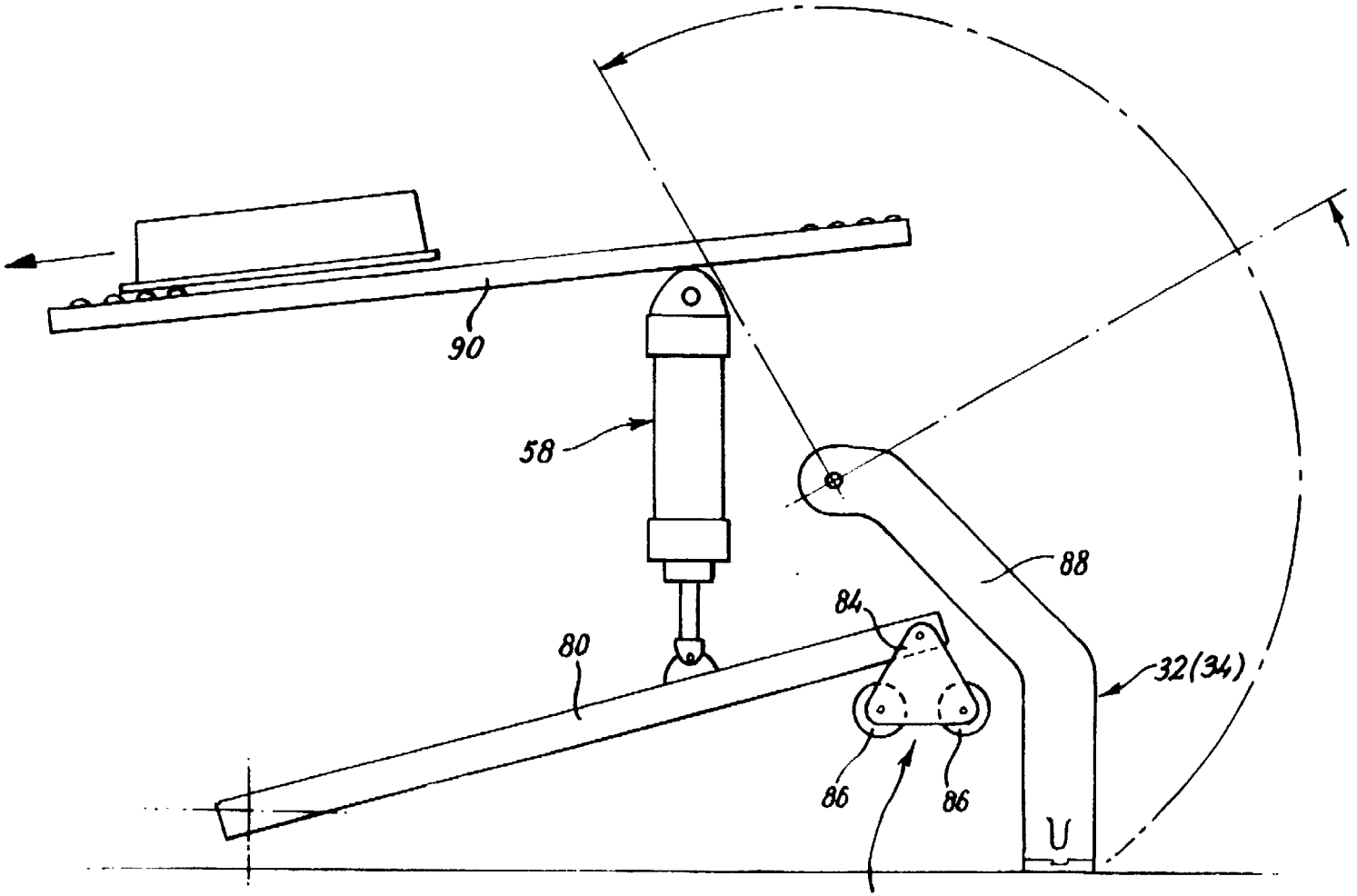

The arms 32, 34 are normally retained in a position extending vertically downwardly of the drive shaft 30, as shown in full lines in FIG. 1, whereby the clamping bar 48 with the pads 50 are in the path of movement of the moulds 22 on the conveyor 12. This position of the arms 32, 34 is checked by a microswitch 52 engaged by a bracket 54 externally of the arm 32. The leading edges of the peripheral lips of the moulds 22, as the latter move off the end of the conveyor 12, as shown in FIG. 1, locate between the jaws of the clamping bar 48. When the moulds 22 engage the pads 50, this operates a microswitch which in turn operates the piston and cylinder assemblies of the clamping bar 48, whereby the pistons 44, 46 are retracted, to close the clamping jaws and clamp the lips of the moulds 22.

A further microswitch on the clamping bar 48 is operated by engagement of the latter with the moulds 22 and energises a motor which rotates the drive shaft 30 and thereby moves the arms 32, 34 forwardly and upwardly through a required angle while the clamping bar 48 grips the lips of the moulds 22.

On a transverse frame member 56 of the apparatus 10, a further piston and cylinder assembly extends downwardly towards the conveyor 12. The cylinder 58 thereof is fixed to the frame member 56 and the free of the piston is connected centrally of a transverse bar 60, each end of which is connected to a free end of a respective one of a pair of longitudinal bars 61. The other ends of the latter are pivotally mounted on the framework. Further bars 62 are adjustably mounted on respective ones of the bars 61 by means of mounting plates 64. At their free ends the bars 61 mount therebetween a freely rotatable transverse roller 66.

Extension of the piston out of the cylinder 58 effectively pivots the roller 66 downwardly through an arc. The roller 66 in its normal position locates above a series of free rollers 68 which locate in a space between the inner end of the conveyor 12 and the inner end of a roller chain offtake conveyor 70.

In a modification, as shown in FIG. 4, the bars 62 are replaced by a restraining arm 80 which, at its free end, pivotally mounts a trolley 82 in the form of a pair of spaced triangular plates 84 between which are mounted a pair of spaced freely rotatable rollers 86.

The arms 32,34 for mounting the clamping bar 48, in this modification are each profiled to have an angled section 88, whereby to locate the clamping bar 48 in a position forwardly of the restraining trolley 82, which can therefore be moved to an operative position prior to commencement of the mould stripping.

In a further modification, a conveyor or other movable support may be provided as an alternative to the three rollers 68.

In operation, after the jaws of the clamping bar 48 clamp on to the lips of the moulds 22, and the bar 48 moved with the arms 32, 34 forwardly and upwardly, the edges of the moulds 22 are effectively stripped from the front ends of the respective products 24. The separating moulds 22 pass below the roller 66 which is then moved downwardly into engagement with the upper surfaces of the moulds 22 to apply a downwardly directed pressure on to the moulds and products, thereby to retain the products 24 on the conveyor 12 and the rollers 68, and facilitate stripping of the moulds 22 from the products 24. The action is to effectively peel the moulds 22 from the products 24 and pull the products 24 through the apparatus and onto the offtake conveyor 70.

When the arms 32, 34 reach the end of the angular travel (as shown in chain dotted lines in FIG. 1), the moulds 22 have totally separated from the components 24 which have moved onto the offtake conveyor 70. In the uppermost position of the arms 32, 34, a microswitch operates to release the clamping jaws whereby the moulds 22 are allowed to fall onto the offtake conveyor 70. The demoulded products 24 are therefore followed on the conveyor 70 by the empty moulds 22. The arms 32, 34 are then returned from their uppermost position to their start position, in order to receive further moulds with products.

In the modification of FIG. 4, the empty moulds may alternatively be deposited on a gravity roller conveyor 90.

The demoulded products 24 then arrive at a collating station 72 from where the demoulded products travel through to a packing station 74 for appropriate handling by operators. The gravity roller conveyors 16, 18 terminate at the collating station 72, where operators can reunite the empty moulds from the conveyor 70 onto empty wooden trays from the conveyors 16, 18, for transport to a moulding location.

It should be appreciated that the load and unloading operations could be carried out automatically by suitable apparatus. Also, instead of being supported in wooden trays, a plurality of moulds may be supported together in a large housing from which the moulds with the products can be simultaneously released and loaded onto the conveyor.

Further, although the described embodiment utilises a twin lane demoulding line, the demoulding line may have more than two lanes, for example up to eight or nine lanes. Because certain dimensions of a range of moulds would remain the same, and because each of the range of moulds is formed with the same peripheral lip, the apparatus can handle moulds whose other dimensions can vary, and can handle such different sizes of moulds simultaneously, whereby the apparatus is very versatile.

There is thus provided a demoulding apparatus which can automatically strip or peel a flexible mould from a concrete product, thereby obviating or mitigating the disadvantages associated with the manual operations. Also, the whole operation is enhanced by the provision for automatically moving empty trays and empty moulds through desired locations to minimise manual handling.

Various modifications may be made without departing from the invention. For example the configuration of the various components may differ from that described and shown, and the invention is not limited to the moulding of concrete building products in flexible polyurethane moulds.

We claim:

1. Demoulding apparatus comprising means (12) for supporting a mould (22) which has an open side and a moulded component (24) therein, characterized in that, for use in demoulding when the mould is supported with the open side facing the supporting means (12), there is provided movable gripping means (48) for releasably gripping the mould (22), and means (32, 34) for moving the gripping means (48) in such a direction away from the support means (12) that a mould (22) formed of a flexible material, when gripped by the gripping means (48), can be stripped from one edge of the component (24) to an opposed edge thereof, whereby to remove the mould (22) from the component (24).

2. Apparatus according to claim 1, characterized by means (60–66) for retaining the moulded component on the supporting means (12) while the mould (22) is stripped from the component (24).

3. Apparatus according to claim 1, characterized in that the supporting means (12) includes a conveyor for moving the mould with the component therein in a linear path to an operative location of the gripping means (48).

4. Apparatus according to claim 3, characterized in that the supporting means further includes means (68) over which the component (24), after leaving the conveyor can continue to move in the linear path as the mould (22) is separated therefrom.

5. Apparatus according to claim 1, characterized in that the gripping means (48) includes a clamp which is movable between an inoperative position and an operative position wherein the clamp grips one edge of the mould (22).

6. Apparatus according to claim 5, characterized in that the clamp is supported by an arm arrangement (32, 34) which is movable through an angle.

7. Apparatus according to claim 5, characterized in that the clamp comprises clamping jaws, the movement of which is pneumatically controlled.

8. Apparatus according to claim 7, characterized in that movement of the clamping jaws is controlled by a pair of spaced pneumatic piston and cylinder assemblies (40–46) towards respective ends thereof.

9. Apparatus according to claim 5, characterized in that the retaining means (60–66) is movable between an inoperative position and an operative position wherein the retaining means (60–66) engages the mould (22) with the component (24) therein in a spaced relation to said one edge, whereby to enable stripping as the component (24) continues to move along a linear path.

10. Apparatus according to claim 9, characterized in that the retaining means is in the form of a freely rotatable roller (66).

11. Apparatus according to claim 9, characterized in that the retaining means is in the form of a trolley with freely rotatable wheels.

12. Apparatus according to claim 10, characterized in that movement of the retaining means is controlled by a pneumatic piston and cylinder assembly (58).

13. Apparatus according to claim 1, characterized in that the apparatus is associated with a further conveyor (16, 18), one end of which is located adjacent to a loading position (14), and the other end of which is located adjacent to means for moving the demoulded component (24) and the empty mould (22), whereby a mould supporting member can be removed from the mould before loading the latter, and the mould supporting member can be moved by the further conveyor (16, 18) from said one end thereof to the other where the mould support member can be reunited with an empty mould (22).

14. Apparatus according to claim 1, characterized in that the apparatus is adapted to strip a plurality of moulds (22) from respective components (24) simultaneously.

15. A demoulding method comprising the steps of supporting a flexible mould (22) with a moulded component (24) therein, and moving the mould (22) with component (24) in a linear path to a location whereat the mould (22) is clamped at one edge thereof, and then moving the mould (22) in a direction away from the supporting means (12), the component (24) continuing to move in the linear path, whereby to strip the mould (22) from one edge of the component (24) to an opposed edge thereof, whereby to remove the mould (22) from the component (24).

16. A method according to claim 15, characterized by the step of retaining the component (24) on the supporting means (12) which the mould (22) is stripped from the component.

17. A method according to claim 15, characterized in that the mould (22) is moved through an angle away from the component (24).

18. A method according to claim 14, characterized in that pressure is applied to the mould (22) with the component (24) therein at a spaced location from said one edge of the mould, whereby to retain the component (24) on the supporting means (12) while separation takes place.

* * * * *